US005599200A

United States Patent [19]

Yagi et al.

[11] Patent Number: 5,599,200

[45] Date of Patent: Feb. 4, 1997

[54] CONNECTOR WITH A TERMINAL PROTECTING BOARD

[75] Inventors: Sakai Yagi; Tamio Watanabe; Toru Nagano, all of Shizuoka, Japan

[73] Assignee: Yazaki Corporation, Tokyo, Japan

[21] Appl. No.: 405,806

[22] Filed: Mar. 16, 1995

[30] Foreign Application Priority Data

Mar. 16, 1994 [JP] Japan ..... 6-045940
Sep. 29, 1994 [JP] Japan ..... 6-235407

[51] Int. Cl.[6] ..... H01R 13/621

[52] U.S. Cl. ..... 439/381; 439/364

[58] Field of Search ..... 439/350–358, 439/364, 381

[56] References Cited

U.S. PATENT DOCUMENTS 5,100,336 3/1992 Burgess et al. ..... 439/364
5,228,867 7/1993 Nagamine ..... 439/364

FOREIGN PATENT DOCUMENTS 63-292584 11/1988 Japan ..... H01R 13/639
647777 1/1989 Japan ..... H01R 13/64
4209479 7/1992 Japan ..... H01R 13/64

*Primary Examiner*—Gary F. Paumen

*Assistant Examiner*—T. C. Patel

*Attorney, Agent, or Firm*—Sughrue, Mion, Zinn, Macpeak & Seas

[57] ABSTRACT

A terminal-protecting-board type connector comprises: a first connector housing into which male terminals are inserted; a terminal protecting board set in the first connector housing; a second connector housing in which female terminals are inserted; and an engaging simple bolt and tightening nut for engaging the first and second connector housings to each other. The terminal protecting board includes a flat plate having terminal supporting holes and extraction holes in correspondence to the terminal accommodating holes of the first connector housing, a pair of locking pieces formed on the rear surface of the flat plate, and a pair of hook pieces formed on the front surface of the flat plate. The first connector housing has a pair of temporary locking ears on the inner surfaces to temporarily lock the terminal protecting board and a pair of locking holes with which the locking pieces of the terminal protecting board are engaged. With this connector, it can be readily detected whether or not the end portions of the male terminals are deformed when inserted into the connector housing, the end portions of the main terminals are positively protected until the engagement of the connector housings has been achieved, and the male terminals can be extracted without removal of the terminal protecting board.

9 Claims, 7 Drawing Sheets

CONNECTOR WITH A TERMINAL PROTECTING BOARD

BACKGROUND OF THE INVENTION

1. Field of the Invention

This invention relates to a connector with a terminal protecting board (hereinafter referred to as "a terminal-protecting-board type connector", when applicable).

2. Discussion of the Prior Art

A variety of connectors are employed for connection of wire harnesses, for instance, in automobiles. That is, one connector is connected to connecting terminals which are connected to a branch line of a wire harness, and another connector is connected to connecting terminals which are connected to conductors, for instance, in an electrical device, and those connectors are engaged with each other so that the wire harness is electrically connected to the conductors.

In this case, the end portions of male terminals inserted in one connector housing protrude through the front end of the connector housing, and are inserted into female terminals in a mating connector housing. Hence, the end portions of the protruding male terminals may be deformed or bent by external force before engagement; or they may be deformed contacting the mating connector housing during engagement.

In order to overcome this difficulty, the following method has been disclosed, for instance, by Japanese Patent Application (OPI) No. 292584/1988 (the term "OPI" as used herein means an "unexamined application"). In this method, a cylindrical terminal protecting device is set in the connector until engagement is accomplished. This will be described in more detail.

As shown in FIG. 12, a female connector 30 has a through-hole 31, in which a male terminal 33 connected to an electric wire 32 is inserted. The male terminal 33 is locked by an elastic lance 34 while being guided by a wall 36. A terminal protecting device 60 is set inside the female connector 30 such that it is slidably movable along the inner surface of a housing 37.

The terminal protecting device 60 includes a holding plate 61 and a first guide 62. The holding plate 61 has a through-hole 63 in its central portion into which the end portion **33*a* of the male terminal 33 is inserted. The first guide 62 is so divided as to embrace the wall 36 and the lance 34, and it is movable in the space between the housing 37 and the lance 34, or the wall 36**.

A second guide 66 is formed as opposed to the holding plate 61, and it has an engaging portion 67 at the end as viewed in the direction of engagement of the connector. The engaging portion 67 is engaged with a recess 69 formed in the housing, to hold the terminal protecting device 60 at a predetermined position in the connector. Since the device 60 is held at the predetermined position in this manner, the end portion **33*a* of the male terminal 33 is held at a predetermined position by the holding plate 61**.

When, as shown in FIG. 13, the female connector 30 is inserted into a male connector 40, the end portion **33*a* of the male terminal 33 is inserted into a through-hole 49 formed in the male connector 40** because it is held at the predetermined position as was described above.

As the female connector 30 is further engaged with the male connector 40, the engaging portion 67 is raised from the recess 69; that is, it is disengaged 20 from the recess 69, so that the terminal protecting device 60 is pushed into the female connector 30. As a result, the end portion **33*a* of the male terminal 33 protrudes through the through-hole 63 of the holding plate 61 and inserted into the female terminal 43**. Thus, the connectors have been engaged with each other.

However, the connector thus designed is disadvantageous for the following reasons:

The end portion **33*a* of the male terminal 33 inserted into the female connector 30 protrudes out of the terminal protecting device 60 through the front end face. Hence, the end portion 33*a* may be bent by something before engagement; or it may be bent while the female connector 30 is being engaged with the male connector 40**.

On the other hand, the male terminal 33 may be inserted into another through-hole of the female connector 30 by mistake. In this case, the male terminal 33 must be extracted with a suitable jig, and for this purpose the holding plate 61 must be removed, which adversely affects not only the connector engaging operation but also connector maintenance work.

SUMMARY OF THE INVENTION

In view of the foregoing, an object of the invention is to provide a connector having a terminal protecting board in which it can be readily detected whether or not the end portions of male terminals are deformed when inserted into the connector housing, and in which the end portions are positively protected until the engagement has been achieved, and in which the male terminals can be extracted without removal of the terminal protecting board.

The foregoing object and other objects of the invention have been achieved by the provision of the following embodiments:

The first embodiment is a terminal-protecting-board type connector comprising

- a first connector housing into which male terminals are inserted,
- a terminal protecting board fitted in the first connector housing, for protecting the end portions of the male terminals, and
- a second connector housing in which female terminals are inserted;

in which, according to the invention,

- in the first connector housing, a temporary locking position is provided for the terminal protecting board so that, when the terminal protecting board is temporarily locked in the first connector housing before the first connector housing is engaged with the second connector housing, the end portions of the male terminals inserted in the first connector housing may not protrude out through terminal supporting holes formed in the terminal protecting board.

In the connector, the first and second connector housings are engaged with each other by tightening an engaging simple bolt which is extended through the centers of the first and second connector housings.

Furthermore in the connector, the temporary locking position for the terminal protecting board is determined by temporary locking ears formed on the inner surfaces of the first connector housing and by locking pieces formed on the rear surface of a flat plate of the terminal protecting board.

The second embodiment is a terminal-protecting-board type connector comprising:

- a first connector housing into which male terminals are inserted, a terminal protecting board fitted in the first connector housing, to protect the end portions of the male terminals, the terminal protecting board including a flat plate having terminal supporting holes in correspondence to terminal accommodating holes formed in the first connector housing, and a second connector housing into which female terminals are inserted;

in which, according to the invention, the flat plate of the terminal protecting board has locking pieces formed on the rear side at both ends in such a manner that the locking pieces are engaged with locking holes formed in the first connector housing, and temporary locking ears are formed on the inner surface of the first connector housing, so that the terminal protecting board is temporarily locked at a predetermined position in the first connector housing.

In this connector, too, the first and second connector housings are engaged with each other by tightening an engaging simple bolt which is extended through the centers of the first and second connector housings.

In the connector, the flat plate of the terminal protecting board has hook pieces formed on the front surface at both ends in such a manner that the hook pieces are engaged with locking recesses formed in the second connector housing.

Furthermore, in the connector, engaging guide pieces are formed adjacent to the terminal supporting holes of the terminal protecting board, respectively, in such a manner that, when the first and second connector housings are engaged with each other, the engaging guide pieces are engaged with terminal extraction holes formed in the front end of the second connector housing, respectively.

Moreover, in the connector, extraction holes for extracting the male terminals are formed in the flat plate of the terminal protecting board near the terminal supporting holes in such a manner that they are confronted with the locking lances in the first connector housing and are isolated from the terminal supporting holes by the separating wall.

In the connector, the extraction holes may be so modified that the extraction holes are smaller in width than the terminal supporting holes with steps between the former and latter holes, and merge with the terminal supporting holes, respectively.

As was described above, in the terminal-protecting-board type connector of the invention, the temporary locking position for the terminal protecting board is provided in the first connector housing so that, when the terminal protecting board is temporarily locked in the first connector housing before the first connector housing is engaged with the second connector housing, the end portions of the male terminals inserted in the first connector housing may not protrude out of the terminal protecting board through the terminal supporting holes formed therein. Hence, it can be readily detected whether or not the end portions of the male terminals are deformed. Furthermore, the end portions of the male terminals are held behind the front surface of the terminal protecting board, and therefore they will never be bent or deformed by external force applied thereto from ahead; that is, they are completely protected by the terminal protecting board.

Furthermore, in the connector of the invention, the flat plate of the terminal protecting board has locking pieces on the rear side at both ends such that the locking pieces are engaged with locking holes formed in the first connector housing, and temporary locking ears are formed on the inner surfaces of the first connector housing, so that the terminal protecting board is temporarily locked at the predetermined position in the first connector housing. Hence, when the male terminals are inserted into the connector housing, it can be determined whether or not their end portions are deformed, and the end portions of the male terminals can be completely protected until the engagement of the connector housings is accomplished.

Moreover, in the connector, engaging guide pieces are formed adjacent to the terminal supporting holes of the terminal protecting board, respectively, that, when the first and second connector housings are engaged with each other, the engaging guide pieces are engaged with the terminal extraction holes formed in the front end of the second connector housing, respectively. Hence, the end portions of the male terminals and the end portions of the female terminals are smoothly guided, so that the former are positively electrically connected to the latter.

Furthermore, in the connector, the extraction holes for extracting the male terminals are formed in the flat plate of the terminal protecting board near the terminal supporting holes such that they are confronted with locking lances in the first connector housing and are isolated from the terminal supporting holes by the separating wall. Further, the extraction holes are made smaller in width than the terminal supporting holes with steps between the former holes and the latter holes, and the extraction holes merge with the terminal supporting holes, respectively. Hence, the male terminal can be extracted from the connector housing readily without removal of the terminal protecting board. The separating walls and the steps prevent the end portions of the male terminals from being inserted into the extraction holes.

The nature, utility and principle of the invention will be more clearly understood from the following detailed description and the appended claims when read in conjunction with the accompanying drawings.

DETAILED DESCRIPTION OF THE INVENTION

Preferred embodiments of the invention will be described with reference to the accompanying drawings.

First Embodiment

A connector having a terminal protecting board, which constitutes a first embodiment of the invention, will be described with reference to FIGS. 1 through 6.

Figure 1:
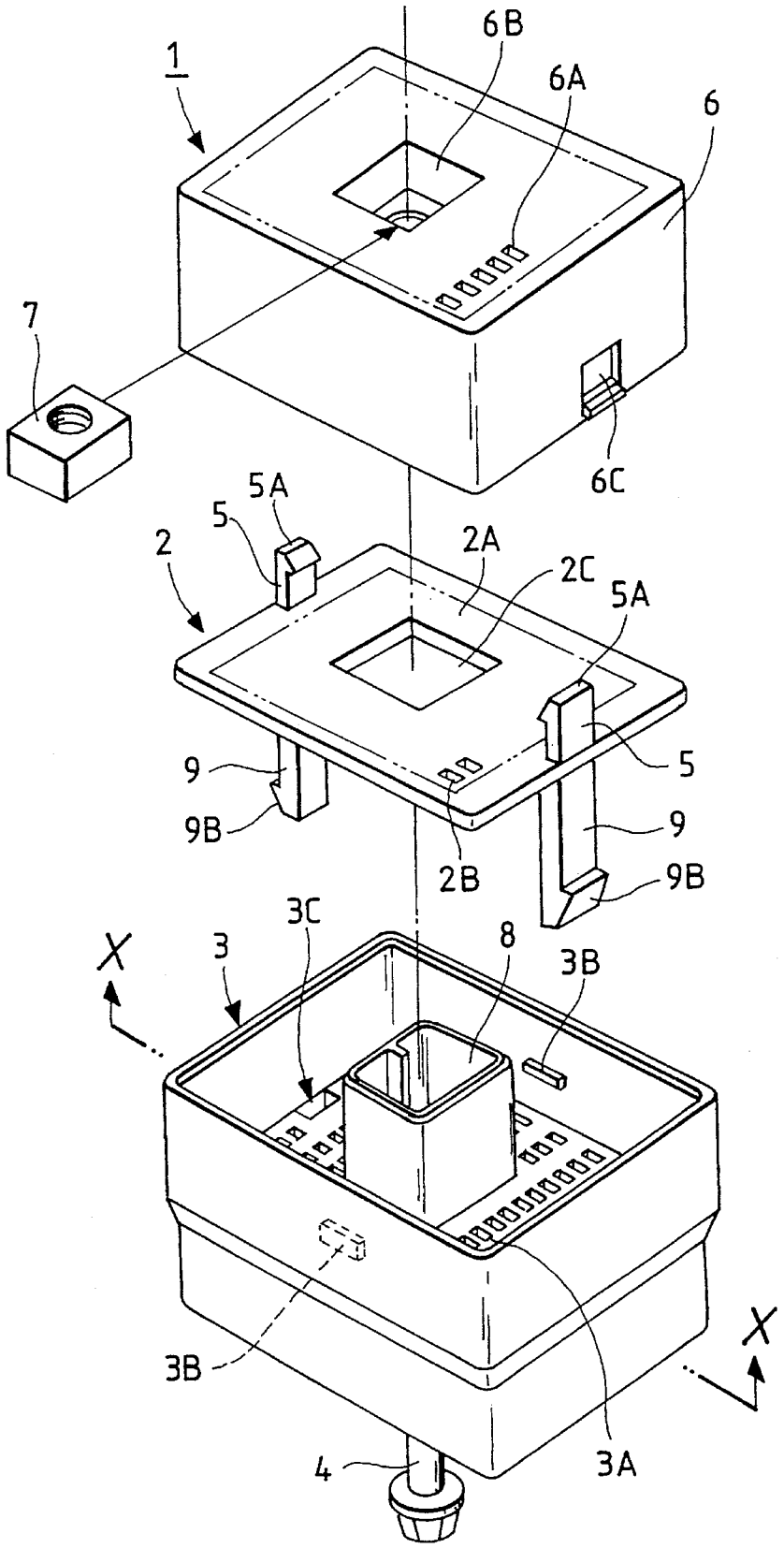
FIG. 1 is an exploded perspective view showing an example of a connector with a terminal protecting board, which constitutes a first embodiment of the invention.

As shown in FIG. 1, the connector 1 comprises: a first connector housing 3 into which male terminals are inserted; a terminal protecting board 2 set in the first connector housing 3; a second connector housing 6 into which female terminals are inserted, the second connector housing 6 having a tightening nut 7; and an engaging simple bolt 4 which is engaged with the nut 7. The first connector housing 3 includes a bolt holder 8. The bolt 4 is inserted through a washer into the bolt holder 8 of the first connector housing 3 from behind (from below in FIG. 1) and through an opening 2C of the terminal protecting board 3 into the second connector housing 6. The bolt 4 thus inserted is threadably engaged with the nut 7 which is fixedly set in a locking hole 6B formed in the rear end wall of the second connector housing 6 at the center.

The terminal protecting board 2 includes: a flat plate 2A which has terminal supporting holes 2B in correspondence to terminal accommodating holes 3A formed in the first connector housing 3; a pair of locking pieces 9 extended from the rear surface of the flat plate 2A and having pawls 9B at the ends; and a pair of hook pieces 5 having pawls 5A at the ends. The flat plate 2A has the aforementioned opening 2C into which the bolt holder 8 of the first connector housing 3 is inserted.

The first connector housing 3 has a pair of temporary locking ears 3B protruding from its inner surfaces, to temporarily lock the terminal protecting board 2; and a pair of through-holes, namely, locking holes 3C into which the locking pieces 9 of the terminal protecting board 2 are inserted, respectively.

The second connector housing 6 has a pair of locking recesses 6C with which the hook pieces 5 are engaged when the engagement has been accomplished.

The terminal protecting board 2 is combined with the first connector housing 3 as follows: First, the locking pieces 9 of the terminal protecting board 2 are inserted into the locking holes 3C of the first connector housing 3, respectively. As a result, the pawls 9B of the locking pieces 9 are locked to pawl receiving pieces 3D which are provided in the locking holes 3C at predetermined positions, respectively. At the same time, the terminal protecting board 2 is abutted against the temporary locking ears 3B. Thus, the terminal protecting board 2 has been temporarily locked to the first connector housing 3.

The temporary locking position of the terminal protecting board 2 is a predetermined position that, when the male terminals 11 are inserted into the first connector housing 3 from behind, the front end portions 11A thereof are inserted into the terminal supporting holes 2B of the terminal protecting board 2 but do not protrude out of those holes 2B.

Figure 2:
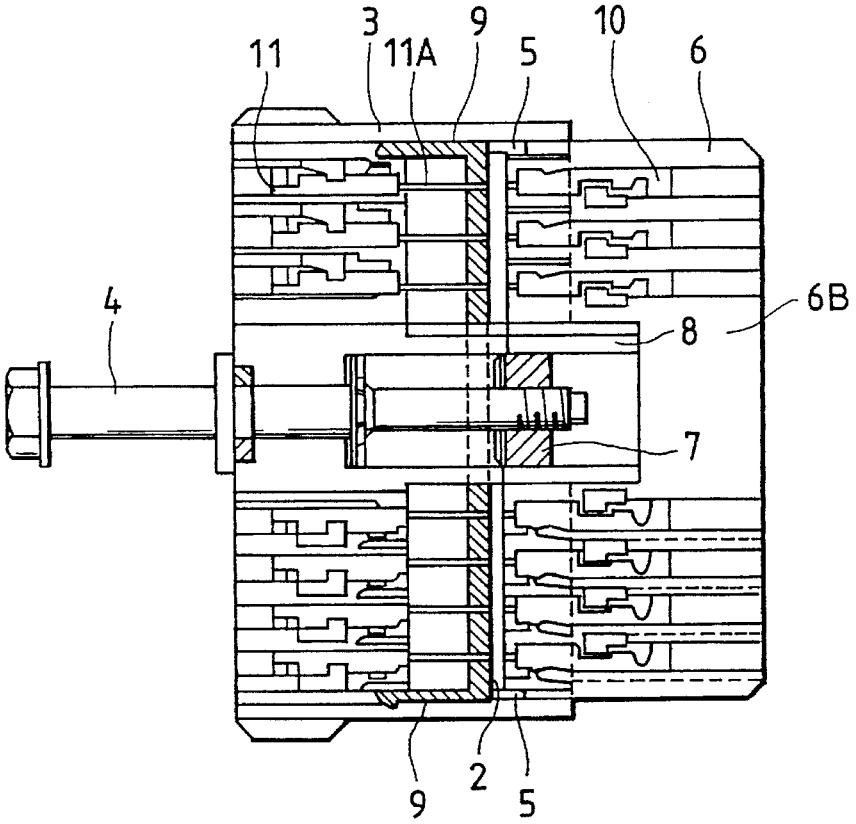
FIG. 2 is a sectional view taken along line X—X in FIG. 1, showing first and second connector housings which are being engaged with each other.
Figure 3:
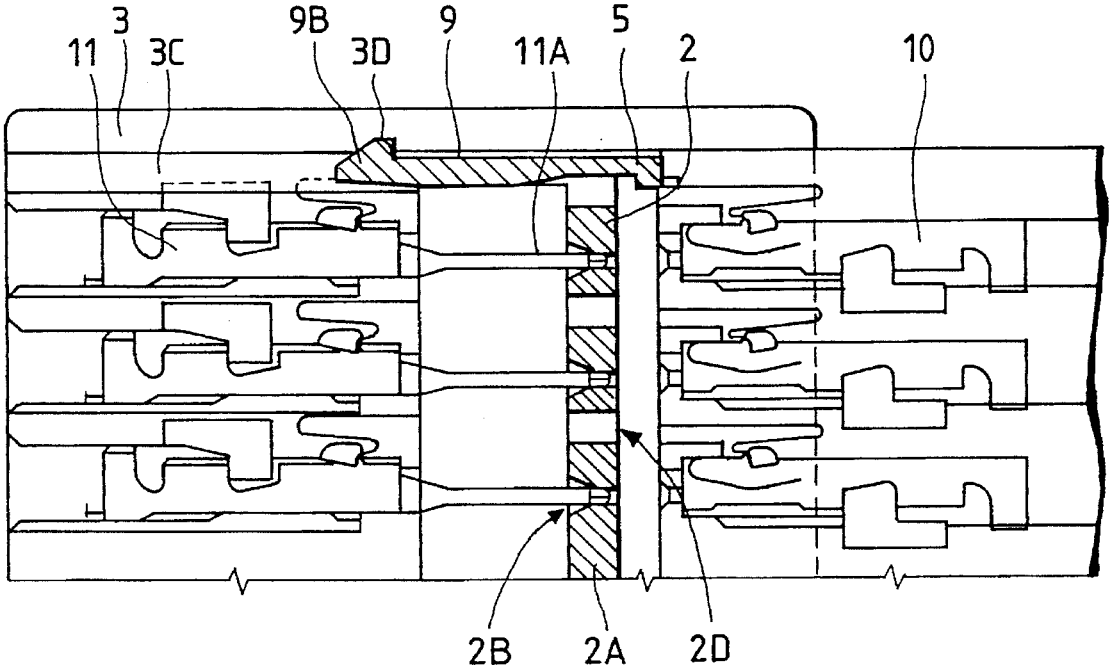
FIG. 3 is an enlarged diagram of a part of FIG. 2.

When, as shown in FIGS. 2 and 3, the terminal protecting board 2 has been temporarily locked, and a predetermined number of male terminals 11 have been inserted into the first connector 3, the end portion of the engaging bolt 4 is thereafter threadably engaged with the nut 7 fixed in the locking hole 6b of the second connector housing 6. In this operation, the two connector housings 3 and 6 are moved towards each other, thus being engaged with each other.

As the end portions 11A of the male terminals 11 are inserted into the terminal supporting holes 2B of the terminal protecting board 2, it can be readily detected whether or not the end portions 11A are in a normal state. Since the end portions 11A do not protrude out of the flat plate 2A, they will never be deformed by external force before or during engagement.

Under this condition (temporary locking condition), the bolt 4 is further tightened so that the connector housings are further engaged with each other; that is, the second connector housing 6 is moved towards the terminal protecting board 2, finally abutting against the latter 2. As the second connector housing 6 is further moved towards the first connector housing 3, the terminal protecting board 2 is pushed thereby, so that the locking pieces 9B are disengaged from the pawl receiving pieces 3D, and the terminal protecting board 2 is moved.

As the terminal protecting board 2 is moved in this way, the end portions 11A of the male terminals 11 are passed through the terminal supporting holes 2B of the terminal protecting board 2, and inserted into the female terminals 10 in the second connector housing 6. Thus, the end portions 11A of the male terminals 11 are prevented from being bent or deformed during the engagement, and can be smoothly inserted into the female terminals 10 in the second connector housing 6.

Figure 4:
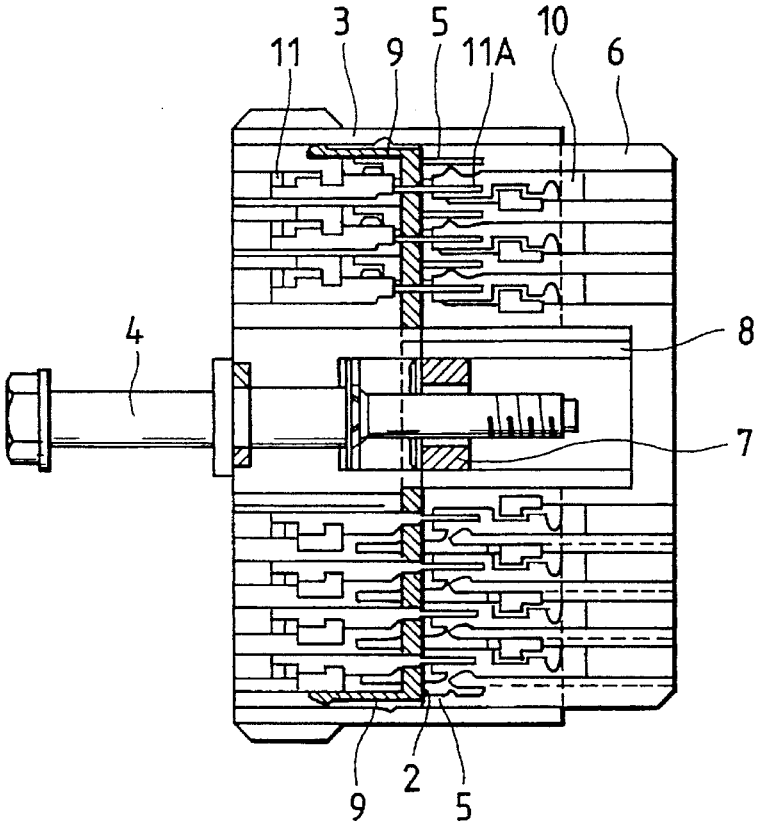
FIG. 4 is a sectional view showing the first and second connector housings have been completely engaged with each other.
Figure 5:
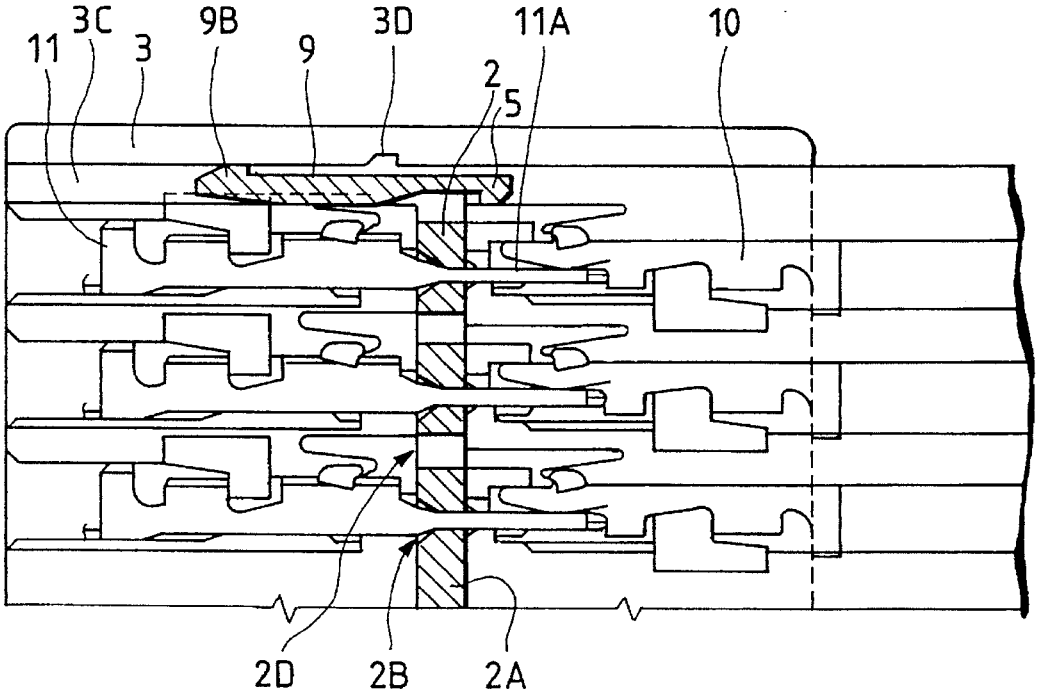
FIG. 5 is an enlarged diagram of a part of FIG. 4.
Figure 6:
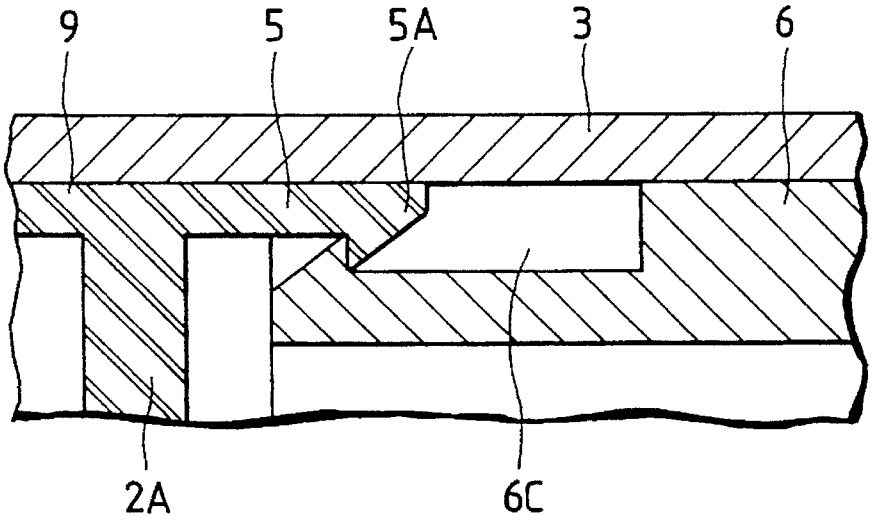
FIG. 6 is an enlarged diagram showing the terminal protecting board which is temporarily locked.

When, as shown in FIGS. 4 and 5, the connector housings 3 and 6 have been correctly engaged with each other, the end portions 11A of the male terminals 11 are completely inserted into the female terminals 10, so that the male terminals 11 are positively electrically connected to the female terminals 10. In this operation, as shown in FIG. 6, the pawls 5A of the hook pieces 5 of the terminal protecting board 2 are engaged with the locking recesses 6C of the second connector housing 6.

The connector housings 3 and 6 may be disengaged from each other as follows: The bolt 4 is turned in the opposite direction so that the second connector housing 6 together with the nut 7 is moved away from the first connector housing. In this operation, since the hook pieces 5 of the terminal protecting board 2 have been engaged with the locking recesses 6C of the second connector housing 6, the terminal protecting board 2 is moved together with the second connector housing 6, so that the pawls 9 of the locking pieces 9 are locked to the pawls receiving pieces 3D. Hence, the hook pieces 5 are disengaged from the locking recesses 6C, and the terminal protecting board 2 is temporarily locked again. Thus, in the connector disengaging operation, too, the terminal protecting board 2 protects the end portions 11A of the male terminals 11 from deformation.

Second Embodiment

A second embodiment of the invention will be described with reference to FIGS. 7 through 9.

Figure 7:
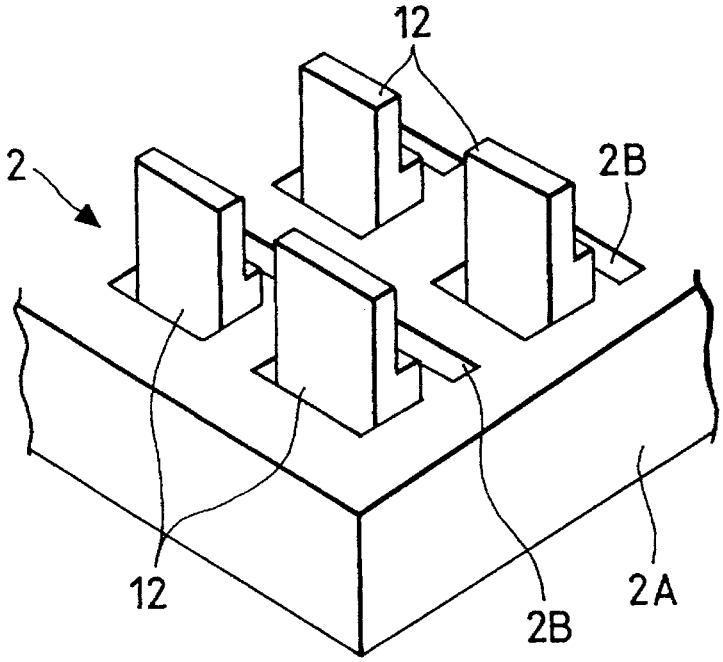
FIG. 7 is a perspective view of another example of the connector, which constitutes a second embodiment of the invention.

In the second embodiment, its terminal protecting board 2 is designed as shown in FIG. 7; that is, protrusions, namely, engaging guide pieces 12 are provided adjacent to the terminal supporting holes 2B of the flat plate 2A of the terminal protecting board 2, respectively. The end portions of the engaging guide pieces 12 are inserted into terminal extraction holes 6D which are formed in the front end of the second connector housing 6. That is, the engaging guide pieces 12 are to guide the connector housing during the engagement.

Figure 8:
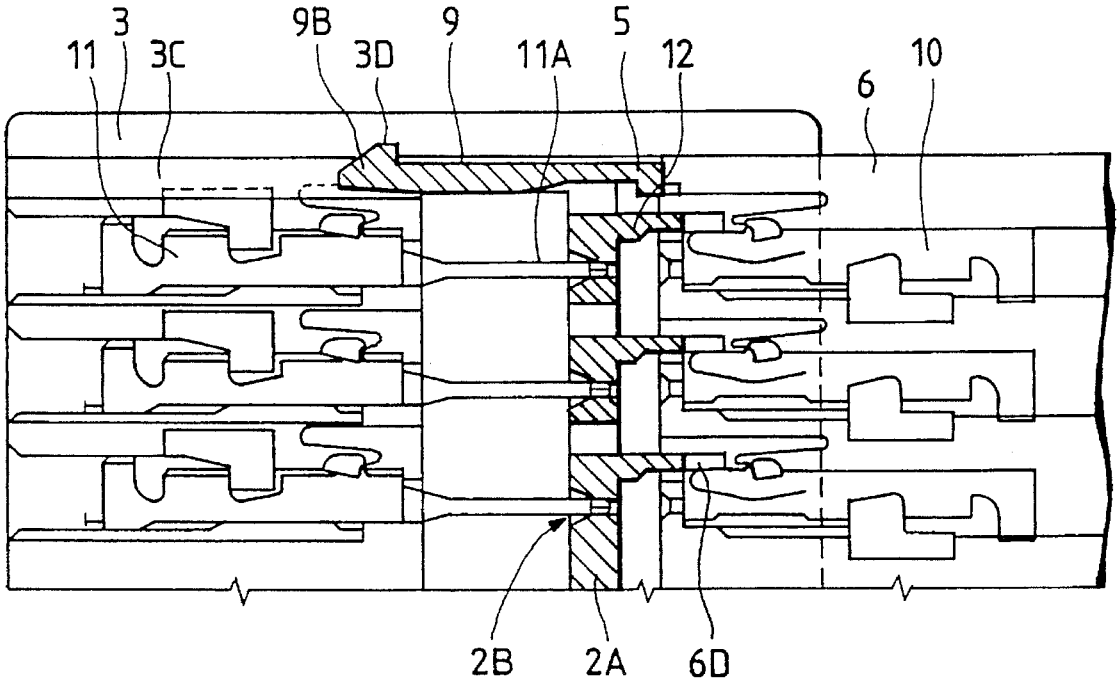
FIG. 8 is an enlarged sectional view showing first and second connector housings in the second embodiment which are being engaged with each other.

Under the condition that the terminal protecting board 2 is temporarily locked as shown in FIG. 8, the bolt 4 is threadably engaged with the nut 7 fixed in the second connector housing 2, so that the latter 2 is moved towards the terminal protecting board 2, and finally abutted against the latter 2. In this operation, the engaging guide pieces 12 of the flat plate 2A of the terminal protecting board 2 are inserted into the terminal extraction holes 6D, so that the end portions 11A of the male terminals 11 are in alignment with the female terminals 10, and the male terminals 11 are positively electrically connected to the female terminals 10.

Figure 9:
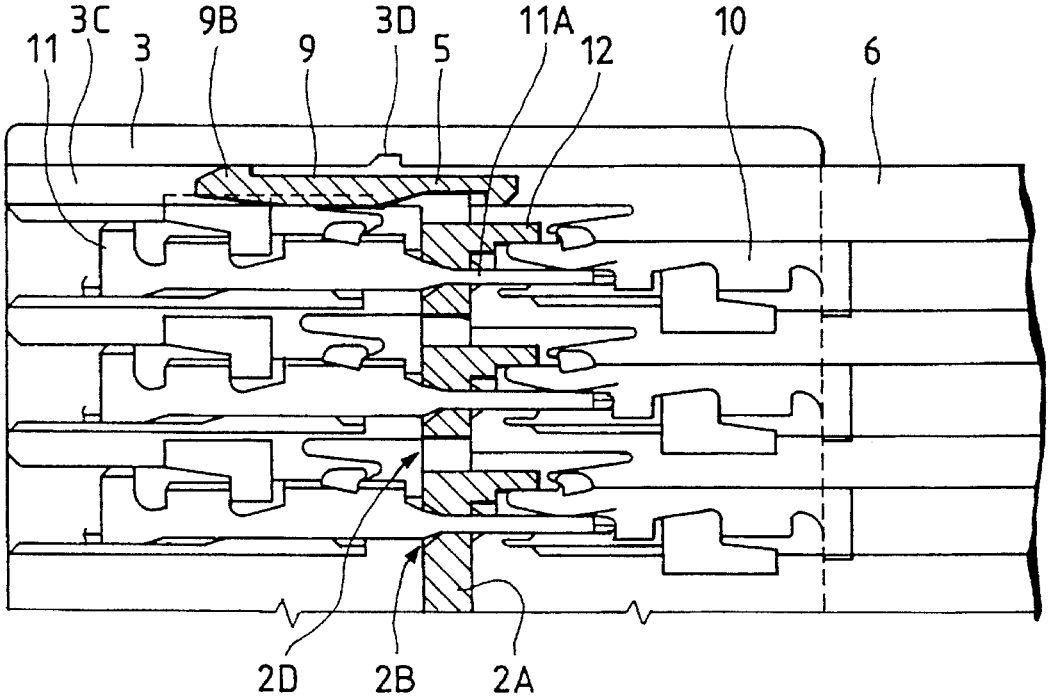
FIG. 9 is an enlarged sectional view showing the first and second connector housings in the second embodiment which have been completely engaged with each other.

When the engagement of the first and second connector housings 3 and 6 is accomplished as shown in FIG. 9, the guide pieces 12 have been inserted deep in the terminal extraction holes 6D formed in the second connector housing 6.

Figure 11:
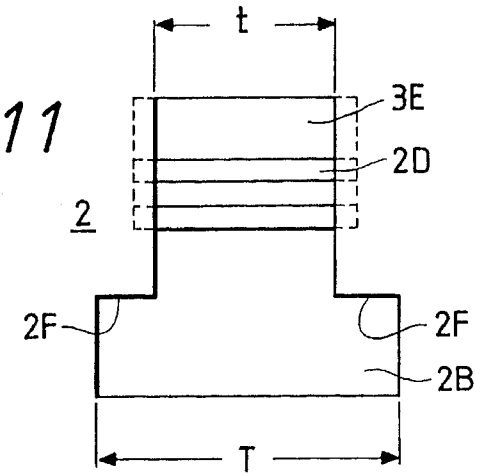
FIG. 11 is a plan view showing another example of the extraction hole which merges with the terminal supporting hole in the terminal protecting board.
Figure 10:
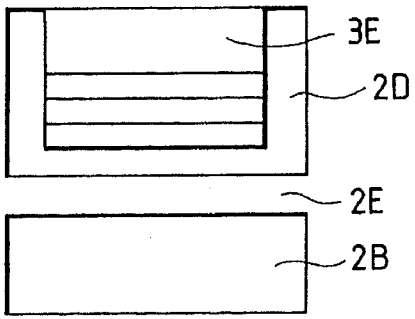
FIG. 10 is a plan view showing an example of an extraction hole formed beside a terminal supporting hole in the terminal protecting board.
Figure 12:
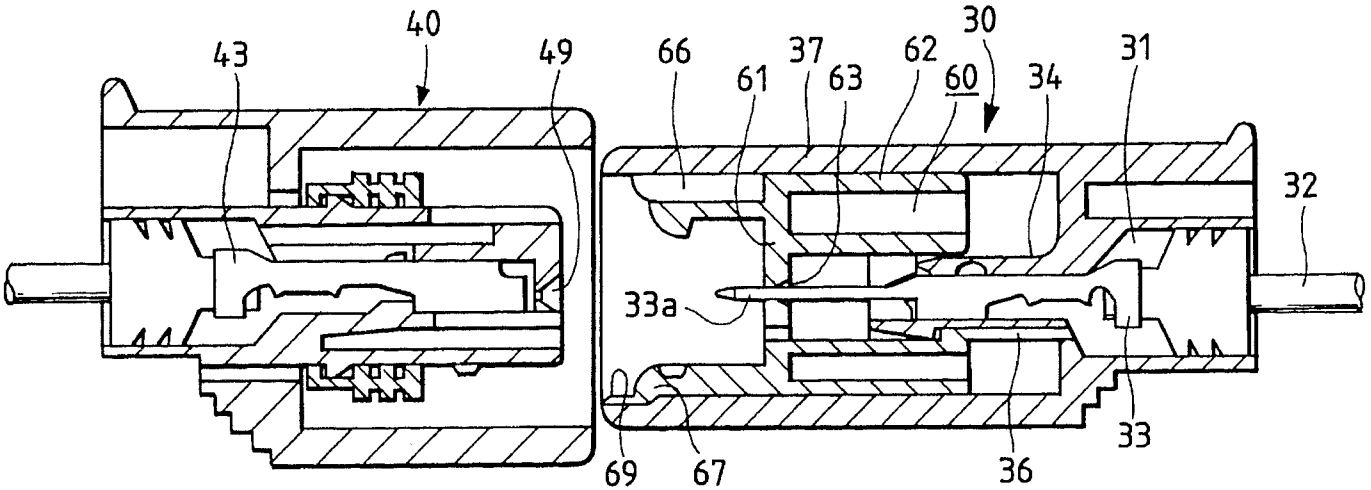
FIG. 12 PRIOR ART
FIG. 12 is a sectional view showing a conventional connector with a terminal protecting board in which connector housings are not engaged with each other yet.
Figure 13:
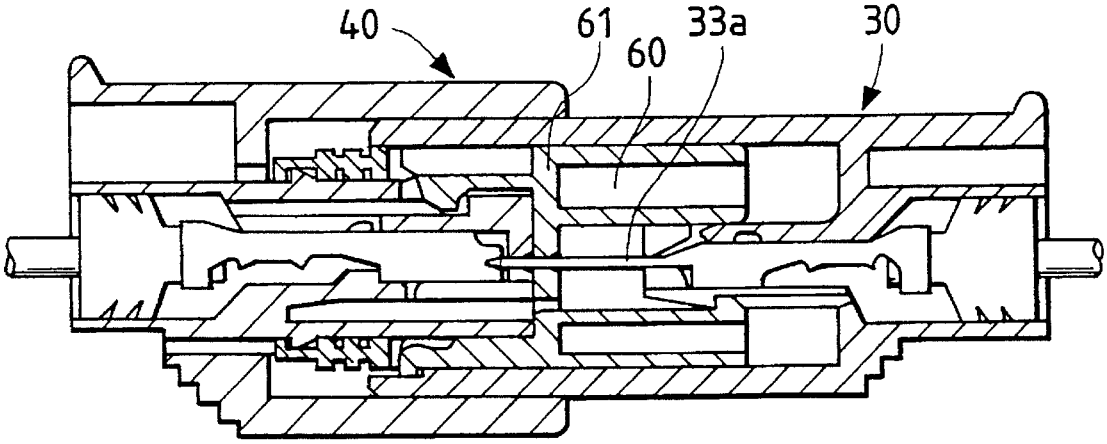
FIG. 13 PRIOR ART
FIG. 13 is a sectional view showing the conventional connector in which the connector housings are being engaged with each other.
Figure 14:
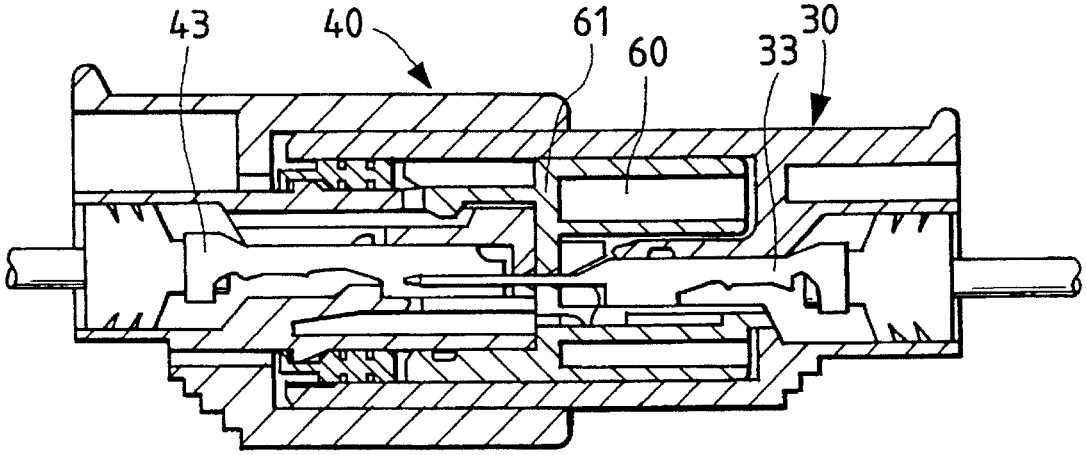
FIG. 14 PRIOR ART
FIG. 14 is a sectional view showing the conventional connector in which the connector housings have been completely engaged with each other.

In the above-described first and second embodiments, as shown in FIGS. 10 and 11, extraction holes 2D are provided near the terminal supporting holes 2B. More specifically, as shown in FIG. 5 or 9, the extraction holes 2D are formed in the flat plate 2A of the terminal protecting board 2 near the terminal supporting holes 2B, respectively, such that the extraction holes 2D are confronted with the locking lances of the first connector housing 3. A jig (not shown) is inserted into the extraction holes 2D to remove the male terminals 11.

That is, as shown in FIG. 10, the jig is inserted into the extraction hole 2D to displace the locking lance 3E, thereby to unlock the male terminal. That is, the male terminal can be extracted without removal of the terminal protecting board 2. As is apparent from FIG. 10, a separating wall 2E is provided between the extraction hole 2D and the terminal supporting hole 2B, which prevents the end portion of the male terminal from being inserted into the extraction hole 2D.

The extraction hole 2D may be modified as shown in FIG. 11. That is, the width t of the extraction hole 2D is smaller than the width T of the terminal supporting hole 2B, and the extraction hole 2D and the terminal supporting hole 2B are combined into one inverted-T-shaped hole having steps 2F. In this modification, the aforementioned separating wall 2E is eliminated, and the male terminal is held by the steps 2F. Since the extraction hole 2D is smaller in width than the terminal supporting hole 2B, the end portion of the male terminal is positively prevented from being inserted into the extraction hole 2D.

While the invention has been described with reference to its preferred embodiments, it should be noted that the invention is not limited thereto or thereby. That is, the invention has been described with reference to the multi-pole connector tightened with the simple bolt; however, the technical concept of the invention may be effectively applied to other connectors which use no engaging simple bolt.

As described above, in the first connector housing of the connector of the invention, a temporary locking position is provided for the terminal protecting board so that, when the terminal protecting board is temporarily locked in the first connector housing before the latter is engaged with the second connector housing, the end portions of the male terminals inserted in the first connector housing may not protrude out of the terminal protecting board through the terminal supporting holes. Hence, it can be readily detected whether or not the end portions of the male terminals are deformed, which eliminates an inspection process in the assembly of the connector. In addition, the end portions of the male terminals are held behind the front surface of the terminal protecting board, and therefore they will never be bent or deformed by external force applied thereto from ahead; that is, they are completely protected by the terminal protecting board.

Furthermore, the flat plate of the terminal protecting board has locking pieces on its rear surface at both ends such that the locking pieces are engaged with locking holes formed in the first connector housing, and temporary locking ears formed on the inner surfaces of the first connector housing, so that the terminal protecting board is positively temporarily locked at a predetermined position in the first connector housing.

In the connector, engaging guide pieces are formed adjacent to the terminal supporting holes of the terminal protecting board, respectively, such that, when the first and second connector housings are engaged with each other, the engaging guide pieces are engaged with the terminal extraction holes formed in the front end of the second connector housing. Hence, when the male terminals are inserted into the connector housing, it can be readily detected whether or not their end portions are deformed, and the end portions of the male terminals can be completely protected until the engagement of the connector housings is accomplished. And the end portions of the male terminals and the end portions of the female terminals are smoothly guided, so that the former are positively electrically connected to the latter.

In the connector, extraction holes for extracting the male terminals are formed in the flat plate of the terminal protecting board near the terminal supporting holes in such a manner that they are confronted with locking lances in the first connector housing and are isolated from the terminal supporting holes by a separating wall. Furthermore, in one modification of the connector, the extraction holes are made smaller in width than the terminal supporting holes, and merge with the latter. This feature positively prevents the male terminals from being inserted into the extraction holes.

While preferred embodiments of this invention have been described, it will be obvious to those skilled in the art that various changes and modifications may be made therein without departing from the invention, and it is intended, therefore, to cover in the appended claims all such changes and modifications as fall within the true spirit and scope of the invention.

What is claimed is:

1. A terminal-protecting-board type connector comprising:

a first connector housing into which male terminals are inserted, a terminal protecting board fitted in said first connector housing, for protecting the end portions of said male terminals, and a second connector housing in which female terminals are inserted;

in which, in said first connector housing, a temporary locking position is provided for said terminal protecting board so that, when said terminal protecting board is temporarily locked in said first connector housing before said first connector housing is engaged with said second connector housing, the end portions of said male terminals inserted in said first connector housing do not protrude through terminal supporting holes formed in said terminal protecting board.

2. A connector as claimed in claim 1, in which said first and second connector housings are engaged with each other by tightening an engaging simple bolt which extends through said first and second connector housings.

3. A connector as claimed in claim 1, in which said temporary locking position for said terminal protecting board is determined by temporary locking ears formed on the inner surfaces of said first connector housing and by locking pieces formed on the rear surface of a flat plate of said terminal protecting board.

4. A connector as claimed in any one of the preceding claims, in which said terminal protecting board has hook pieces formed on its front surface such that said hook pieces engage with corresponding locking recesses formed in said second connector housing.

5. A connector as claimed in any one of the preceding claims, in which engaging guide pieces are formed adjacent to said terminal supporting holes of said terminal protecting board, respectively, such that, when said first and second connector housings are engaged with each other, said engaging guide pieces are engaged with female terminal extraction holes, for extracting said female terminals, formed in the front end of said second connector housing, respectively.

6. A terminal-protecting-board type connector comprising:

a first connector housing into which male terminals are inserted;

a terminal protecting board fitted in said first connector housing, to protect the end portions of said male terminals;

said terminal protecting board including a flat plate having terminal supporting holes in correspondence to terminal accommodating holes in said first connector housing;

said flat plate of said terminal protecting board further comprising locking pieces on its rear side, said locking pieces engagable with corresponding locking holes in said first connector housing;

temporary locking ears on the inner surfaces of said first connector housing, for temporarily locking said terminal protecting board at a predetermined position in said first connector housing such that the end portions of said male terminals do not protrude through said terminal supporting holes of said terminal protecting board;

a second connector housing into which female terminals are inserted.

7. A connector as claimed in claim 6, in which said first and second connector housings are engaged with each other by tightening an engaging simple bolt which is extends through said first and second connector housings.

8. A connector as claimed in any one of the preceding claims, in which male terminal extraction holes for extracting said male terminals are formed in said flat plate of said terminal protecting board near said terminal supporting holes, respectively, such that said male terminal extraction holes are confronted with locking lances in said first connector housing and are isolated from said terminal supporting holes by a separating wall.

9. A connector as claimed in claim 8, in which said male terminal extraction holes are smaller than said terminal supporting holes, with steps being provided between said male terminal extraction holes and said terminal supporting holes, and said male terminal extraction holes merge with said terminal supporting holes, respectively.

* * * * *